United States Patent [19]

Müller

[11] Patent Number: 5,040,587

[45] Date of Patent: Aug. 20, 1991

[54] FOUNDRY MOLD FORMING PRODUCTION METHOD AND SYSTEM

[75] Inventor: Günter Müller, Karlsruhe, Fed. Rep. of Germany

[73] Assignee: BMD Badische Maschinenfabrik Durlach GmbH, Karlsruhe, Fed. Rep. of Germany

[21] Appl. No.: 490,090

[22] Filed: Mar. 7, 1990

[30] Foreign Application Priority Data

Mar. 14, 1989 [DE] Fed. Rep. of Germany ..... 3908203

[51] Int. Cl.[5] ..... B22C 15/02; B22C 25/00

[52] U.S. Cl. ..... 164/18; 164/194

[58] Field of Search ..... 164/18, 194, 37, 180

[56] References Cited

U.S. PATENT DOCUMENTS

| | | | |
|---|---|---|---|
| 2,985,931 | 5/1961 | Frankenstein | 164/18 |
| 3,802,487 | 4/1974 | Feller | 164/194 |
| 4,135,570 | 1/1979 | Muller | 164/194 X |
| 4,167,208 | 9/1979 | Buhrer | 164/18 |

FOREIGN PATENT DOCUMENTS

| | | | |
|---|---|---|---|
| 1198015 | 8/1965 | Fed. Rep. of Germany | 164/194 |
| 3713937 | 11/1988 | Fed. Rep. of Germany . | |
| 938230 | 10/1963 | United Kingdom | 164/194 |

*Primary Examiner*—J. Reed Batten, Jr.

*Attorney, Agent, or Firm*—Frishauf, Holtz, Goodman & Woodward

[57] ABSTRACT

To permit greater through-put of a mold box filling and compacting system, mold boxes are moved vertically by a lifting table which passes through the station transport turret (10) to place a pattern or mold carrier plate (11, 12) in the mold box, and, upon continued vertical movement, placing a filling frame (14) about the mold box, and, upon further vertical movement, placing the thus formed subassembly in engagement with a sand filling apparatus (15). Upon subsequent lowering, the subassembly is returned to the turret, the turret rotates and places the subassembly in position for alignment with a compacting station, raises the subassembly to the compacting station for compaction of the sand about the model or pattern. The subassembly is then lowered; after lowering for a short distance, the fill pattern transport, for example another turret or pivotable arm system, is placed in interfering position with the filling frame so that it is stripped off the mold box which is then lowered on a removal conveyor, for removal from the compacting station; continued downward movement at the compacting station table then places the now freed pattern or model carrier plate again on the station transport turret for return to the first position. Sand filling and compaction can be carried out simultaneously on sequentially arriving mold boxes under control of a control system (C) which controls appropriate sequencing.

15 Claims, 4 Drawing Sheets

FOUNDRY MOLD FORMING PRODUCTION METHOD AND SYSTEM

FIELD OF THE INVENTION

The present invention relates to a method to make foundry molding forms, and to an apparatus which carries out the method, in which empty mold boxes are supplied to a sand filling station, a pattern is placed in the mold box, a filling frame placed around the mold box, sand is filled and is then compacted in a compaction station, the frame removed, and the compacted patterned mold box transported away for further handling in the foundry.

BACKGROUND

Foundry production systems are known in which pattern or model carrier plates, carrying patterns or models to be cast are placed in molding sand boxes, the molding sand boxes then transported to a filling station and subsequently transported to a compacting station. This arrangement permits filling one mold box with sand in the time that another mold box is compacted. A plurality of pattern plates with patterns thereon are used, the patterns being returned to the initial station as the various operating steps in the mold box are carried out. Simultaneous filling of one mold box, while another one is being compacted, increases the through-put of mold boxes per unit time. It is, however, still quite time-consuming to completely assemble the mold box to the pattern or model carrier plate, then assemble a filling frame around the mold box and, after filling with sand and compaction, to again separate the pattern or model carrier plate and the filling frame from the mold box. An auxiliary vessel is needed which has a volume of approximately that of the mold box and the filling frame for assembly of the pattern or model carrier plate thereto. As a consequence, since the model or pattern carrier plate is introduced into the filling frame from below, a plate large enough to cover the auxiliary vessel and not only the molding frame is needed, which increases the energy requirement to lift the carrier plate.

THE INVENTION

It is an object to provide a method and an apparatus to make foundry molds in a way which is simpler, faster, requires less apparatus and less operating energy.

Briefly, the method includes the steps of separating the filling frame from the mold box after compaction and prior to removal of the mold box by a removal transport system, for example a roller conveyer, and returning that so separated filling frame individually to the filling station for placement on another empty mold box being supplied by a supply conveyer system, for example another roller conveyer. By providing two pattern plates and two units to separate the filling frame from the mold box after compaction, two mold boxes can be simultaneously processed in sequential steps. In accordance with a preferred feature of the invention, a rotary or turret arrangement is provided to move the mold box from the filling station to the compaction station, the arrangement also permitting, essentially simultaneously or with just very short time differences, to separate or strip the filling frame from the mold box after compaction and to place it on a second next subsequently empty arriving mold box.

The filling frame, in accordance with a feature of the invention, is thus separated from the mold box after compaction before that mold box is removed from the compaction station, for return to the filling station.

This sequence of steps, and the apparatus to carry it out, has the advantage that a mold box, arriving next subsequent to the one which had been filled, can be fitted with the filling frame and lifted by a lifting ram operating the model carrier plate to the filling station, without any additional vertical movement being necessary, for immediate filling of sand. Assembling together the model on the model plate, the mold box and the filling frame, can be carried out in one single working step as the mold box is raised towards a filling Position in the filling station.

A further advantage is provided by the invention since, upon lowering of the mold box after compaction, the filling frame can be separated or lifted off or stripped off the mold box, so that the mold box will be free of the filling frame when it reaches its normal or lowered position for transport away by the removal transport system.

The apparatus, in accordance with a feature of the invention, includes two shifting devices to position filling frames first for assembly to a mold box prior to filling, and then for removal from the mold box after compaction. This shifting arrangement or repositioning arrangement includes movable holding elements which, upon lifting movement of the filling frame, can be positioned in the path of the filling frame, or out of the path thereof, and into a quiescent or rest position. This ensures that the filling frame can be introduced in the filling station, and, upon removal of the holder elements from that path, can be dropped and moved in a position in alignment with a ram or other vertically operating plunger or piston element for placement in alignment with a compaction station. Upon raising of the box with the pattern carrier plate and the filling frame thereon, the filling frame must clear the holder device or arrangement, so that it can be engaged with the compaction station. After compaction, however, the holder device or arrangement comes close to the mold box so that, upon continued downward movement, the filling frame is separated from or stripped off the mold box, thereby permitting, for one, the mold box to drop further, and being placed on the removal transport system and, for another, the filling frame to be returned to the filling station for reuse in a second next subsequent mold to be filled with sand.

The moving system for the filling frame could be a linearly operating shifting mechanism, or a pivot arm. In accordance with a preferred feature of the invention, however, the moving system both for the filling frame as well as for the pattern or model carrier plate is a turret rotatable about a vertical axis. This turret can be arranged to, simultaneously, ensure that the empty mold boxes are properly received and the mold boxes with the formed pattern therein and the compacted sand are properly supplied to the removal transport system.

DRAWINGS

FIG. 5 illustrates the position of the filling frame when it is held by the holder arrangement.

DETAILED DESCRIPTION

Figure 1:
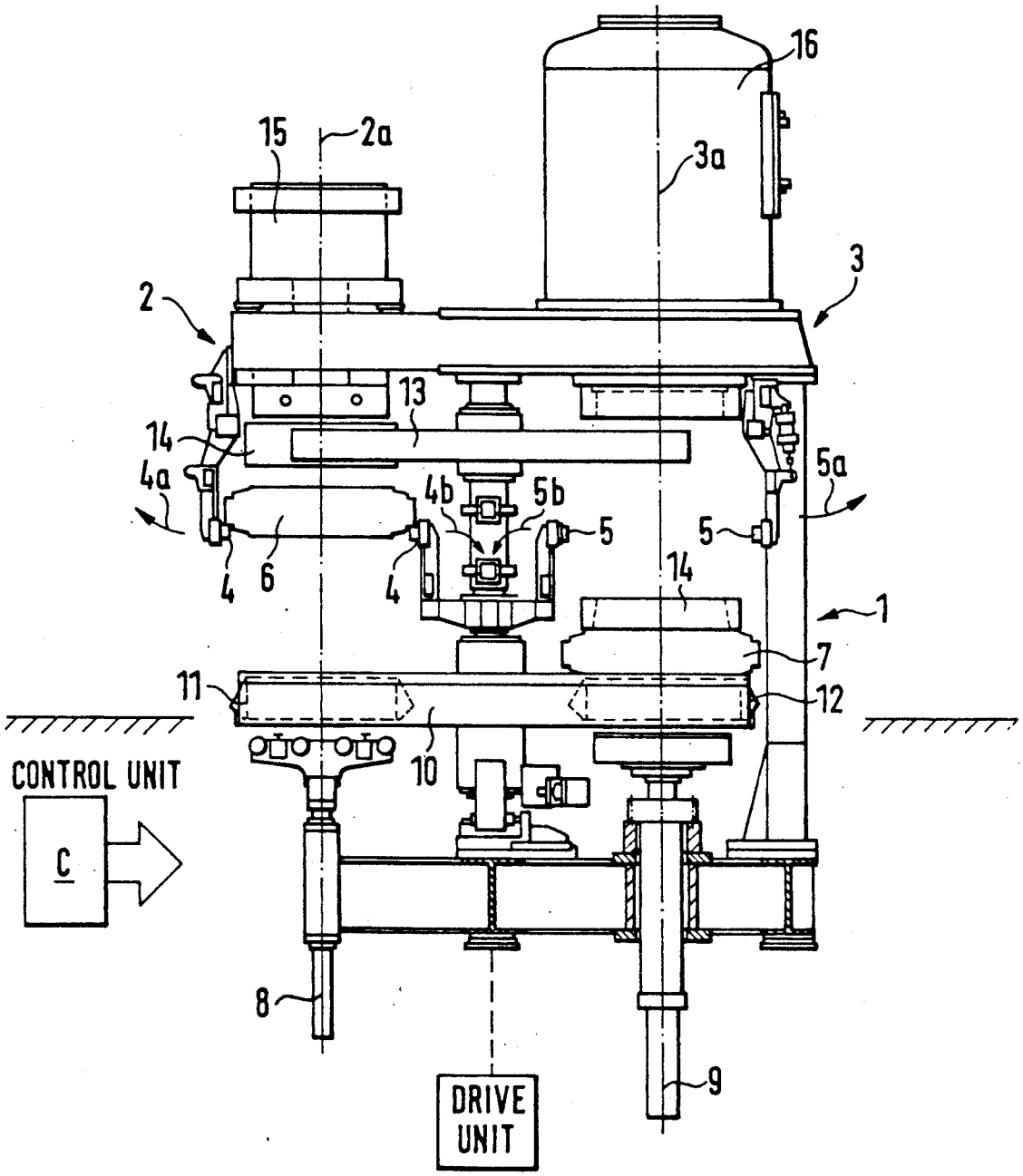
FIG. 1 is a highly schematic side view of the system of the present invention, with which the method will be illustrated.
Figure 2:
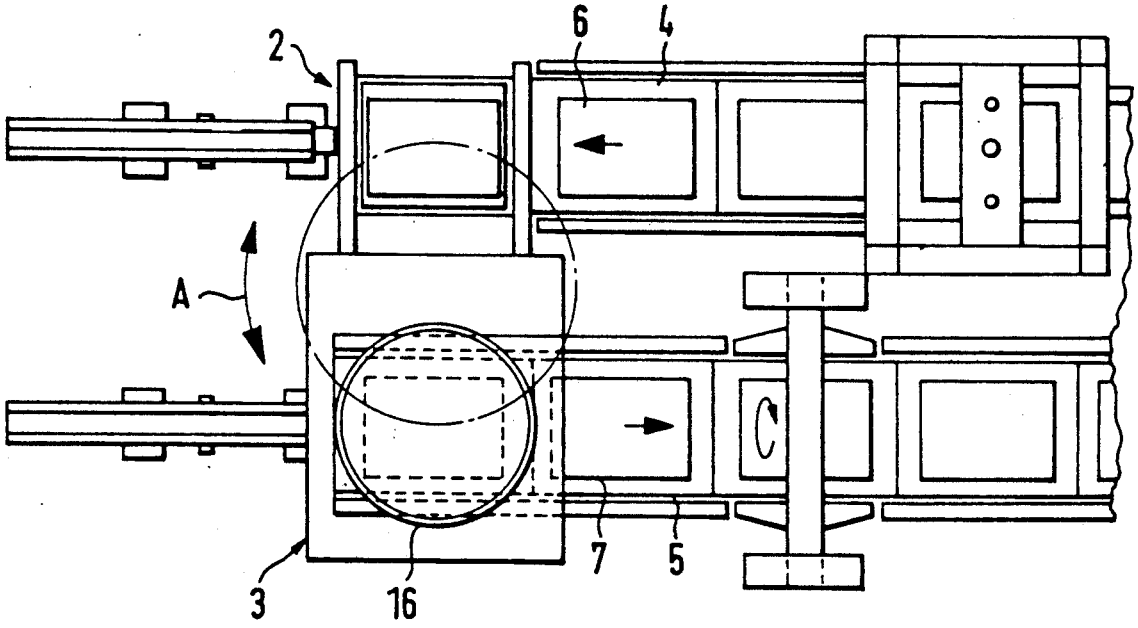
FIG. 2 is a top view of the system of FIG. 1.

A common frame 1 retains a filling station 2 and a compaction station 3 for mold boxes. The operation of these stations, by and themselves, do not form part of the present invention; they can be conventional in accordance with any well-know structure. Parallel roller conveyer systems 4, 5, extending perpendicularly to the plane of FIG. 1, supply empty mold boxes 6 and remove filled mold boxes 7, as best seen in FIG. 2. To permit handling of the mold boxes 6, 7, at the respective filling and compacting stations 2, 3, portions of the transport systems or conveyors 4, 5 can be flipped sideways as shown schematically by the arrows 4*a*, 4*b* and 5*a*, 5*b*. This permits free passage for the mold boxes 6 in vertical direction when moved in position for filling or compacting. The mold boxes are moved vertically by a lifting table 8, shown schematically only, associated with the filling station 2 and another lifting table 9 shown associated with the compacting station 3. The tables 8, 9 are vertically movable, for example by a hydraulic ram, a rack-and-pinion arrangement coupled to an electric motor and the like.

In accordance with a feature of the invention, a turret 10, rotatable about a vertical axis, is located centrally between the lifting and lowering tables 8, 9. The turret 10 retains two reception areas to hold pattern or model carrier plates 11, 12.

A second turret table 13, in accordance with a feature of the invention, is located above the turret 10 coaxially thereto, the turret 13 being arranged to shift filling frames 14 in position to be aligned with the vertical axis of movement 2*a* associated with the filing station and, respectively, the axis 3*a* associated with the compacting station. The turret 13 transports filling frames 14 after compaction back to alignment with the filling station 2. Its construction will be described below with reference to FIGS. 4 and 5.

The filling station includes a sand supply holder 15, located in the upper region of the filling station, and above the lifting table 8. The sand supply 15, which may be a hopper, has a flap or valve closure at the bottom in order to fill a required quantity of sand into a mold box 6.

The compacting station 3 includes a pressure vessel 16 which, upon release of pressure against the sand, provides for compaction thereof by a pressure pulse. Other types of compaction can be used, and the compaction station 3 may include mechanical or different types of compaction units as well.

BASIC OPERATION

Empty mold boxes 6 are supplied over the roller conveyer 4 to the filling station 2, as well known. The lifting table 8 lifts the model plate carrier 11 out of the turret 10, then accepts the mold box 6 from the roller conveyer 4, and then places the filling frame 14 from the turret 13 about the mold box 6. The thus telescopically assembled parts are carried tightly against the lower side of the sand container 15. During filling with sand of the subassembly formed by the model or pattern carrier 11, the box 6 and the filling frame 14, the rollers of the roller conveyer 4, in the region of the filling station, are pivoted outwardly in accordance with arrows 4*a*, 4*b*. Holder elements 17, 18 (FIG. 4) connected to the turret 13 are pivoted outwardly so that the assembly of model plate carrier 11, box 6 and filling frame 14, after filling with sand, can be lowered by the table 8 to the turret 10.

Figure 4:
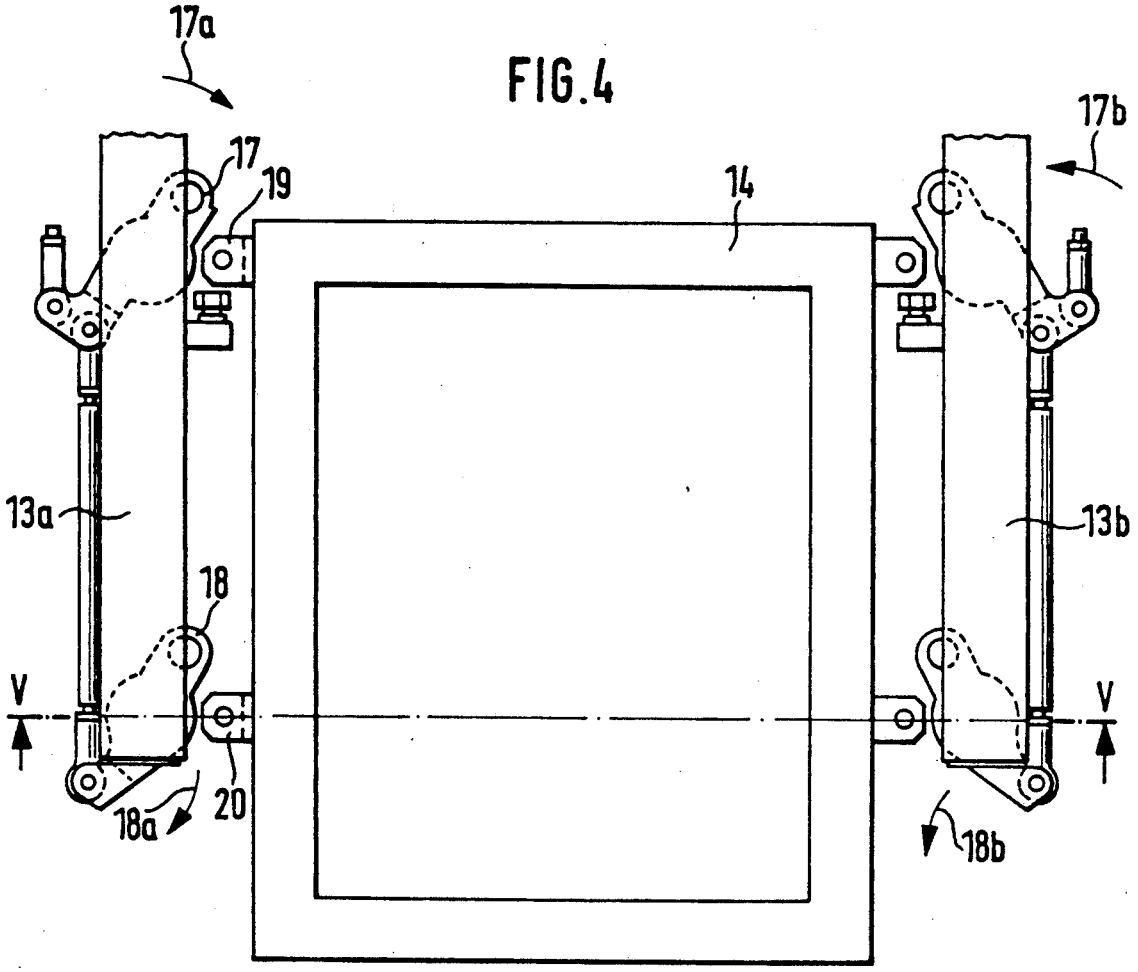
FIG. 4 is an enlarged detail top view of the holding arrangement for a filling frame.
Figure 5:
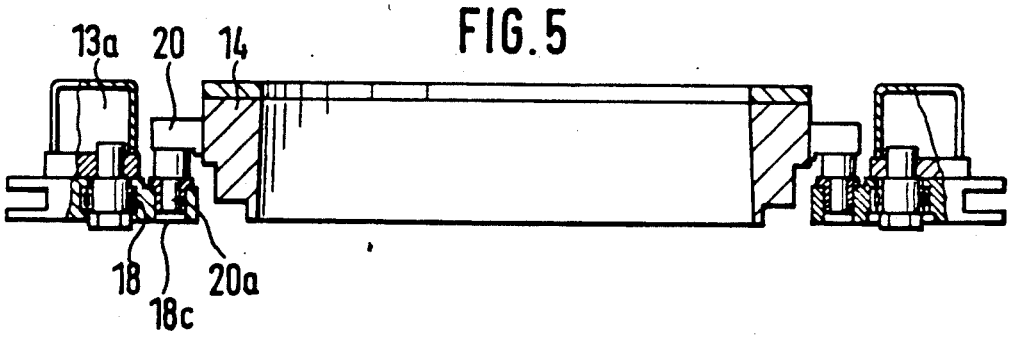
FIG. 5 is a cross section along line V—V of FIG. 4, in which, however.

FIGS. 4 and 5 illustrate the details of the turret 13 and the filling frame 14 and the holding system therefor.

The turret 13 includes two parallel pivot arms 13*a* and 13*b*, spaced from each other by a distance somewhat greater than the length of a filling frame 14. Horizontally pivotable holder elements 17, 18 are secured to the arms 13*a*, 13*b*. The holder elements 17, 18 are arranged to cooperate with projections 19 and 20 formed on the filling frame 14. FIG. 4 illustrates the holder elements in their withdrawn or rest position, in which the filling frame will clear the holder elements and can easily move past the turret 13 in a vertical direction. FIG. 5 illustrates the holder elements in engaged position, that is, rotated in the direction of the arrows 17*b*, 18*b*, 17*a*, 18*a*. The holder element 18 has a bore 18*c* at the end thereof into which a guide pin 20*a* of the projection 20 can engage from above. This provides for an interengaging projection-and-recess fit, while permitting the raising table 8 to lift the filling frame 14 out of engagement with the pivotable holder elements 17, 18 and raise it upwardly.

The holder elements 17, 18, forming pivot links, are operated in any suitable manner, for example by a pneumatic cylinder, coupled to suitable operating links, as shown only schematically. The control of the entire system, and the sequencing of steps is carried out by a control unit C (FIG. 1) which provides suitable control signals to operate the tables 8, 9, pivoting of the rollers 4, 5, supply of sand from filling element 15, compaction in compactor 16, as well as pivoting of the links 17, 18.

Drives other than pneumatic cylinder may be used, as well known.

FIG. 4 illustrates the position of the holder elements 17, 18 after the box 6 has been filled with sand; the roller elements 4 in the region of the filling station are pivoted outwardly, see arrows 4*a*, 4*b*, so that the table 8 together with the assembly of the mold or pattern plate 11, sand box 6 and filling frame 14 can be lowered, until the pattern plate 11 is seated on the turret 10. The turret 10 is then rotated by 180° to come in alignment with the axis 3*a* of the compacting station 3. At the same time, the turret 13 brings a filling frame 14 from a box 7 which had previously been subjected to compaction, to return that frame 14 to the filling station 2. Also, the rollers 4 are pivoted back into the position shown after the assembly 11-6-14 has cleared the outwardly pivoted rollers 4, to receive a new box 6.

Figure 3:
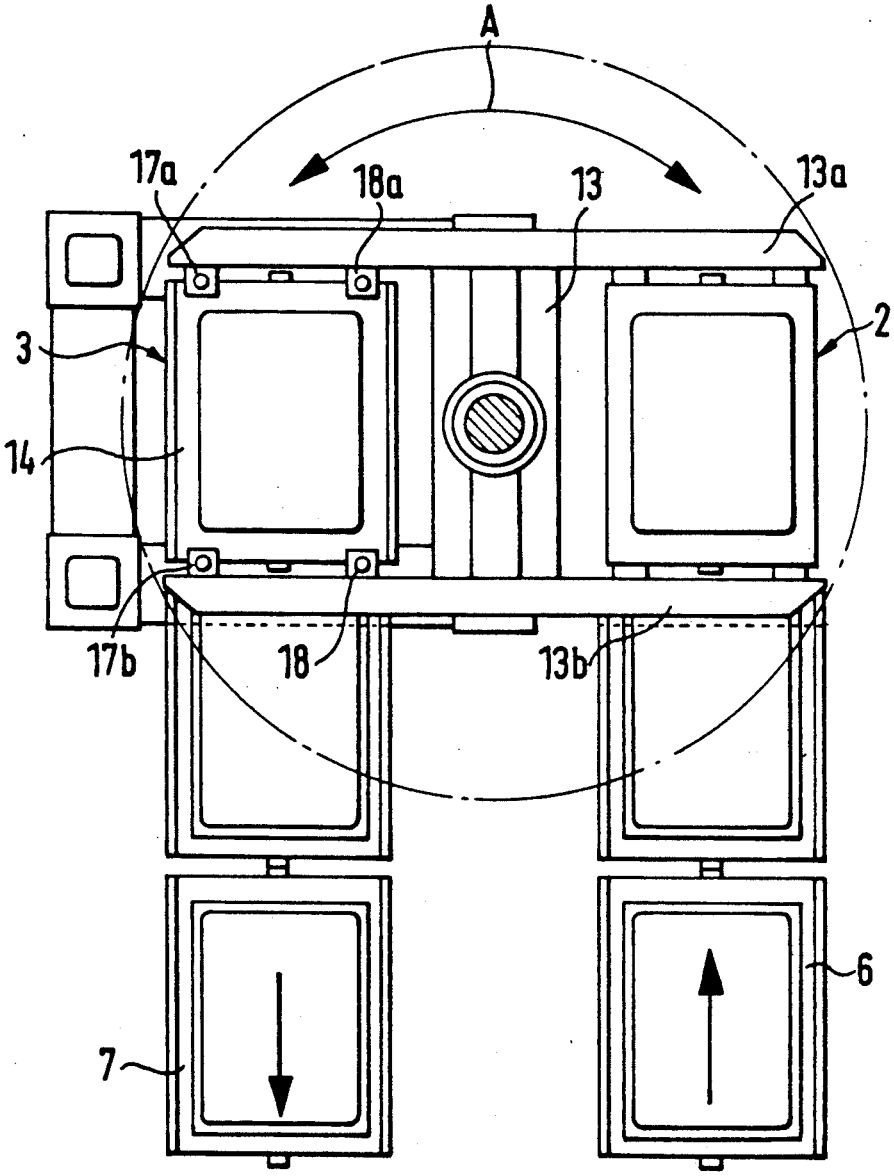
FIG. 3 is an enlarged top view of the turret arrangement to move the filling frames.

The filled assembly 11-6-14, after pivoting by turret 10 as schematically shown by the arrow A (FIGS. 2, 3), is now accepted by the raising table 9, which is moved upwardly. The removal transport system 5 is repositioned so that the rollers in the region of the compacting station 3 are pivoted outwardly, see arrows 5*a*, 5*b*. Likewise, the holder elements 17, 18 are pivoted in the clearance position shown in FIG. 4. The assembly 11-6-14 is tightly pressed against the compacting vessel 16, and a pressure pulse is generated therein. At that time, the holder elements 17, 18 are pivoted in the direction of the arrows 17*a*, 17*b*, 18*a*, 18*b* into the holding position, and the roller elements in the region of the compacting station of the roller system 5 are pivoted back into the full-line position shown in FIG. 1.

After compaction, the table 9 is lowered. Thus, the filling frame 14 will be engaged by the holder arms 17, 18 and held in the turret 13. Frame 14, will be stripped off box 7. The mold box 7 contains the compacted molding sand, and can be transported away from the compacting station by the roller conveyer 5. Further lowering of the table 9 places the model or pattern plate on the turret 10 which, upon rotation, see arrow A, will place it again in the position where it can be used to supply a model or pattern for the second next subsequent box 6 on roller conveyer 4.

The lifting movement of the table 8 can be carried out approximately simultaneously with the lifting movement of the table 9, so that compaction and filling can be carried out simultaneously with sequential mold boxes. Compaction, thus, is carried out with a mold box which was supplied in the next preceding operating cycle.

The sequence of operation shows that the separate transport of the filling frame 14 by the turret 13 enables telescoping assembly of the model plate carrier 11, the mold box 6, and the filling frame 14, and filling thereof as well as compaction, and then disassembly of the filling frame 14 from the mold box and removal of the pattern and pattern carrier can be carried out in a single vertical stroke, each, so that, simultaneously, one mold box is filled in the filling station while a previously filled mold box is subjected to compaction in the compaction station. The arrangement thus provides substantially improved through-put with respect to prior art apparatus, while using only simple structural elements which are reliable and do not require any complex structures. Sequential control, by the control unit C, can be carried out in a well known programming manner.

The system is equally suitable for alternately arriving lower and upper boxes in a standard forming machine as well as for operation with two different patterns and molds in a double forming machine.

The turrets 10, 13 can be driven individually or in common. A drive 1013 is provided which, for example through a shaft, operates both units 10, 13 together or, via a hollow shaft, operates units 10, 13, individually. Individual operation permits slight temporal offset between stripping of a frame 14 off the assembly after lowering from the compacting station 3 with respect to return of the model or pattern on its model or pattern plate 11 or 12, respectively, to the left side position, with reference to FIG. 1. Alternatively, the drive unit 1013 can be so constructed that, selectively, it drives either the turret 10 or the turret 13 individually, or in unison.

Various changes and modifications may be made within the scope of the inventive concept.

I claim:

1. In a method of making foundry molding forms, wherein a supply transport system (4) transports empty mold boxes (6) to a sand filling station (2), said sand filling station including a filling frame carrier (13) movably retaining a filling frame (14) thereon;

a mold or pattern carrier (8) is vertically movable in the path of the empty mold box and a filling frame, and, upon lifting of the empty mold box, places a model or pattern plate (11) in, and the filling frame about the mold box, while moving towards the filling station (2);

the filled mold box and frame are then moved to a compacting station (3) for compaction of sand filled in the mold box and, after compaction, the pattern and filling frame are separated from the mold box; and a removal transport system (5) transports the completed compacted mold box (7) from the compacting station (3), and the improvement comprising the steps of separating the filling frame (14) from the mold box (7) after compaction and prior to removal of said mold box (7) by the removal transport system (5); and returning said so separated filling frame (14) individually to the filling station (2) for placement on another empty mold box (6) being supplied by said supply transport system (4) upon vertical lifting of said another mold box.

2. The method of claim 1, wherein said step of separating the filling frame from the mold box comprises lowering the filling frame and the mold box for a limited distance, and retaining the filling frame (14) on the filling frame carrier (13), the mold box with the compacted sand therein continuing vertical downward movement;

and including the step of essentially horizontally moving the filling frame into alignment position with the other empty mold box (6) for placement about said other mold box upon lifting of the other empty mold box.

3. The method of claim 1, wherein the model or pattern plate carries a pattern or model thereon;

and including the step of removing the pattern or model plate (11, 12) from the mold box (7) after compaction and moving it in alignment with the other mold box, said step of moving the pattern or model plate (11, 12) being carried out essentially simultaneously with movement of the filling frame (14) after separation from the mold box subsequent to compaction, and for placement in position over the other empty mold box.

4. Foundry production system for filling empty mold boxes, placing a molding pattern or model therein, and compacting the filled mold boxes, and removing the filled compacted mold boxes, comprising a supply transport means (4);

a filling station (2) receiving empty mold boxes (6) from the supply transport means;

said filling station having a vertically movable lifting table (8);

a pattern or model carrier plate (11, 12) located in the movement path of said lifting table;

means (13) for retaining a filling frame; and a sand filling apparatus (15), the lifting table receiving the pattern carrier plate, and placing the pattern carrier plate into an empty mold box and moving it through a filling frame (14) towards the sand filling apparatus, and, after filling, lowering the subassembly formed by the mold box, pattern or model carrier plate and filling frame;

a compacting station (3);

station transport means (10) for transferring a filled subassembly to the compacting station (3) from the filling station (2), said compacting station (3) having a vertically movable compacting table means (9); and a compaction head (16), said compacting table means, after compaction, lowering the subassembly to permit separation of said filling frame (14) and said pattern or model carrier plate (11, 12) from the subassembly; and removal transport means (5) for removing the mold box with the compacted modeled sand therein from the compaction station, said system further comprising a filling frame transport means (13) located above said station transport means (10) for placing a filling frame separated from said mold box after compaction in the compacting head and returning said frame to the filling station for placement on another mold box being supplied by said supply transport means (4).

5. The system of claim 4, wherein movable positionable holder elements (17, 18) are provided, located on said filling frame transport means (13) and means for controllably moving said holder elements (17, 18), selectively, in engagement position with a filling frame or out of engagement position with respect thereto and permitting free passage of a filling frame past said holder elements.

6. The system of claim 5, wherein the filling frame (14) is formed with lateral projections (19, 20) located for engagement by said holder elements when the holder elements are in an interfering position with respect to said projection.

7. The system of claim 4, wherein said filling frame transport means (13) comprises a pivotable arm.

8. The system of claim 7, wherein said pivotable arm is located centrally between the filling station (2) and the compacting station (3) and said station transport means (10) comprises a turret arranged to retain at least two pattern or model carrier plates (11, 12) thereon.

9. The system of claim 8, wherein said filling frame transport means (13) comprises a rotatable means and said turret (10) and said rotatable means are located for rotation about a common axis.

10. The system of claim 9, wherein said common axis is formed by a common shaft.

11. The system of claim 4, wherein said supply transport means (4) comprises a conveyer terminating adjacent said filling station; and said removal transport means comprises a conveyer (5) starting at said compacting station.

12. The system of claim 11, further including a control system (C) controlling transport of mold boxes being supplied by said supply transport means and being removed by said removal transport means and controlling the station transport means for synchronized supply and removal of mold boxes and shifting of said subassembly and said pattern or model carrier plates (11, 12), respectively, by said station transport means (10).

13. The system of claim 11, wherein said supply transport means and said removal transport means are positioned essentially parallel with respect to each other.

14. The system of claim 4, further including a drive unit (1013) for each of said station transport means and said filling frame transport means and individually operable to move said filling transport means and said station transport means.

15. The system of claim 4, further including a drive unit (1013) coupled to both said station transport means (10) and said filling frame transport means (13) to provide a common drive to move said station transport means and said filling transport means.

* * * * *